US006581786B1

(12) United States Patent
King et al.

(10) Patent No.: US 6,581,786 B1
(45) Date of Patent: Jun. 24, 2003

(54) SUSPENDED SHOE RACK

(75) Inventors: William D. King, O'Fallon, MO (US); Frederick D. Oberhaus, Ballwin, MO (US)

(73) Assignee: Industrial Wire Products, Inc Missouri Corp., Sullivan, MO (US)

( * ) Notice: Subject to any disclaimer, the term of this patent is extended or adjusted under 35 U.S.C. 154(b) by 227 days.

(21) Appl. No.: 09/250,617

(22) Filed: Feb. 16, 1999

Related U.S. Application Data

(60) Provisional application No. 60/074,822, filed on Feb. 17, 1998.

(51) Int. Cl.[7] ..... A47F 7/08

(52) U.S. Cl. ..... 211/34; 211/119; 211/38

(58) Field of Search ..... 211/38, 34, 119, 211/181.1, 113, 90.03, 106, 106.01; 248/153, 175, 302–304, 214, 339, 308; D6/458, 462, 566; 206/503, 505–507, 513, 515, 517, 519

(56) References Cited

U.S. PATENT DOCUMENTS

| | | | | | |
|---|---|---|---|---|---|
| D23,450 | S | * | 7/1894 | Heffner | 211/34 X |
| 803,274 | A | * | 10/1905 | Deaver | 211/117 |
| 1,304,847 | A | * | 5/1919 | Blais et al. | 211/37 X |
| 1,423,417 | A | * | 7/1922 | Gorman | 211/38 |
| 1,874,056 | A | * | 8/1932 | Matallana | 211/38 |
| 1,927,997 | A | * | 9/1933 | Weston | 211/38 |
| 1,961,870 | A | * | 6/1934 | Weston | 211/37 |
| 2,078,613 | A | * | 4/1937 | Sieber | 211/113 |
| 2,195,919 | A | | 4/1940 | Crilly et al. | |
| 2,294,504 | A | * | 9/1942 | Knape | 211/38 |
| 2,299,021 | A | * | 10/1942 | Hoffman | 211/34 |
| 2,389,910 | A | * | 11/1945 | Hoffman | 211/34 |
| 2,603,393 | A | * | 7/1952 | Oblusteel | 211/37 X |
| 2,623,640 | A | * | 12/1952 | Ougheltree | 211/34 |
| 2,827,254 | A | | 3/1958 | Faber | |
| 2,901,117 | A | * | 8/1959 | Plocki et al. | 211/38 |
| 3,198,344 | A | | 8/1965 | Pollock | |
| 3,730,354 | A | * | 5/1973 | Bronstein | 211/38 |
| 3,913,745 | A | | 10/1975 | Weiss | |
| 3,918,670 | A | | 11/1975 | Doherty | |
| 4,133,589 | A | * | 1/1979 | Johns | 211/34 X |
| 4,666,201 | A | * | 5/1987 | Chap | 211/119 X |
| 4,765,495 | A | * | 8/1988 | Bisk | 211/113 |
| 5,076,442 | A | | 12/1991 | Hakeem | |
| D369,483 | S | * | 5/1996 | Kandel | D6/566 |
| 5,526,941 | A | | 6/1996 | Ford | |
| 5,695,073 | A | | 12/1997 | Klein et al. | |
| 5,788,093 | A | * | 8/1998 | Krut | 211/119 |

* cited by examiner

*Primary Examiner*—Daniel P. Stodola
*Assistant Examiner*—Jennifer E. Novosad
(74) *Attorney, Agent, or Firm*—Paul M. Denk

(57) ABSTRACT

A suspended shoe rack providing a series of horizontally, or slightly inclined, shoe supports laterally within a structure of a rack, between a pair of side rods, and guide line or stabilizing rods, with the side rods providing structure for supporting the racks to a closet door, during usage. In addition, a plurality of such shoe racks may be nested together, to facilitate their packing assembly, for shipment, storage, or when displayed for sale.

1 Claim, 2 Drawing Sheets

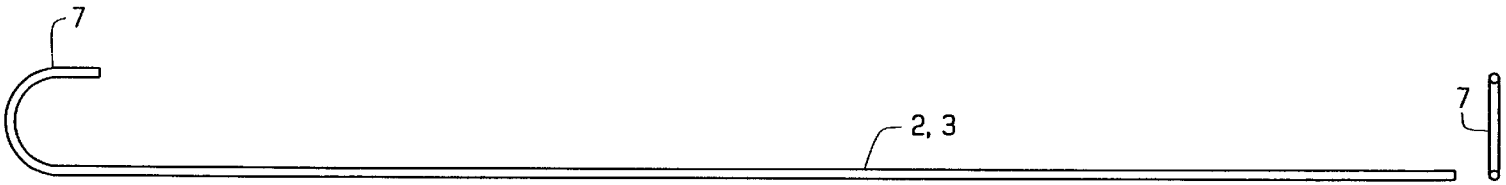
FIG. 5
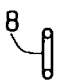
FIG. 6
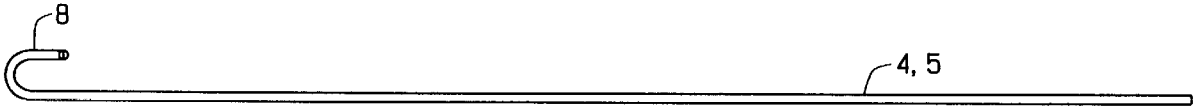
FIG. 7
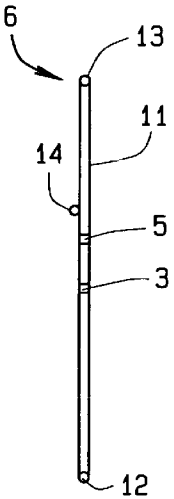
FIG. 8
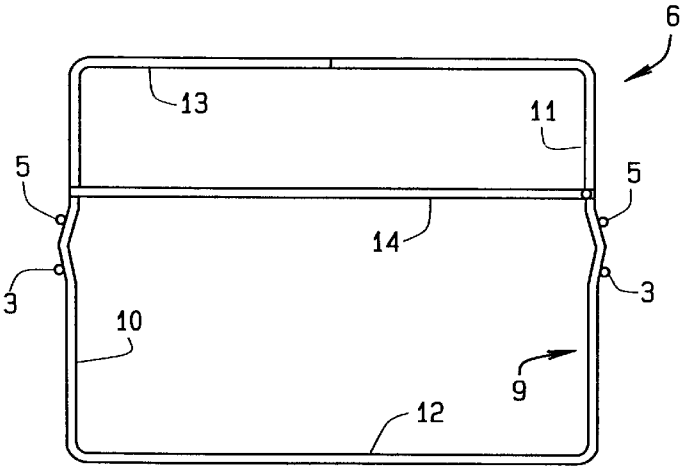
FIG. 9
FIG. 10

SUSPENDED SHOE RACK

This application claims the benefit of Application No. 60/074,822 filed Feb. 17, 1998.

BACKGROUND OF THE INVENTION

Various types of racks for use for supporting shoes have long been available in the art. There are a wide variety of patents upon racks, for holding shoes, but Generally these types of racks are rested upon the ground, and have a multitude of pairs of shoes simply rested thereon, during their storage and non-usage. In addition, there are also suspension type of means for holding footwear, and which can be even suspended from a wall, a door, or perhaps even from a closet rod, and usually these type of prior art shoe holding means includes some type of a plurality of pouches, formed into a plastic or cloth holder, and into which the vamp of the pairs of shoes insert, to temporarily store the shoes, when not worn.

The current invention provides a different style of shoe rack, one which can be conveniently. suspended from a closet rod, and readily display a multitude of pairs of shoes visually, to the front, to allow for ease of selection and removal for application and wearing, but can be just as easily replaced, as when not in infuse.

SUMMARY OF THE INVENTION

This invention contemplates the formation of a suspended shoe rack, of the type that may be applied to a closet rod, or other means of support or supporting, and allow for a plurality of pairs of shoes to be applied thereto, as during temporary storage, or non-usage, conveniently out of place, but readily available for selection and application, when needed.

This invention includes the use of at least a pair of suspension rods, which includes means at their upper ends for suspending the rods from a closet rail, rod, or the like, or from any other means of support. Where at least a pair of such suspension rods are used, a series of parallel arranged shoe supports are integrally formed, are secured by welding, or any other means of connection, to the suspension rods, and these supports are slightly inclined, so as to provide for their front edge to be somewhat lower than the rear edge, so that when shoes are applied thereto, as during storage, the vamps of the shoes are readily available for inspection and visual selection, for immediate removal and application for usage.

The supporting platforms for the shoes, may be to any width, and can hold just a pair of shoes, or many pairs of shoes, as desired, and since a series of vertically arranged such supports are provided within the structure of this shoe rack, a multitude of shoes, usually all that can be worn by the user, can be applied to this suspension shoe rack, as when the pairs of shoes are not in use.

Further included in the structure of the shoe supports for this invention are strategically located horizontal braces, that are designed for gripping of the heels of the shoes, and to function for two purposes, to hold the pairs of shoes in support, during storage, but likewise, to prevent their slippage forwardly, by hooking onto the front edge of the heels of the shoes when stored, as during application of this rack.

In addition, a further attribute of the structure of this invention is the inclusion, optionally, of an additional suspension rod down the side of the formed shoe rack, at least on one side edge of the rack, but perhaps on both side edges, so as to stabilize the structure of the rack when formed and welded or otherwise secured together, and likewise to furnish additional support, in the event that any one of the welds or fastening means should fail, the secondary suspension rod will function as the means for holding the shoe supports in place, for continuing and repeat usage.

In addition, because of the uniquely designed fabrication of the suspension shoe racks, and because their shoe supports are arranged upon an incline, a large number of such racks can be nested together, into what may be described as a packing assembly, so as to allow a plurality, or large number, of such racks to be packaged, shipped, stored, and displayed, at the retail market place, utilizing a minimum of storage or shelf space, when displayed for sale.

It is, therefore, another object of this invention to provide a suspension shoe rack, wherein a plurality of them may be packed into an assembled configuration, nested together, so as to significantly reduce the space of their assembly, when packaged for shipment, storage, or displayed for marketing.

Another object of this invention is to provide a suspension shoe rack which includes a series of parallel arranged and horizontally aligned two supports, which may hold a pair or a large number of pairs of shoes, as during temporary storage, for the convenience of the owner.

Another object of this invention is to provide a shoe rack which very conveniently locates within a closet, can be suspended from the closet rod, and provide a means for temporary storage of all of the shoes of the owner, in a concentrated location.

A further object of this invention is to provide a suspension shoe rack that is properly oriented, in its structured assembly, so as to conveniently display the vamps of the shoes for ready observance by the owner, to assist him/her in footwear selection for usage and application for that day.

Another object of this invention is to provide a suspension shoe rack which incorporates structure that assures the continuing usage and application of the rack, even after long term application and usage, and even in the event any of the integral means for fastening, or welding of the components together should fail, due to long term usage and application.

Another object of this invention is to provide a convenient shoe rack which is streamlined in structure, conveniently utilizing various angled and arcuate elements within its structure so as to avoid the incidence of scratching or damage to the owner, during long term usage and application for storing of multiple pairs of shoes conveniently within a closet, or at other locations.

These and other objects may become more apparent to those skilled in the art upon reviewing the summary of the invention as provided herein, and upon undertaking a study of its preferred embodiment in view of the drawings.

BRIEF DESCRIPTION OF THE DRAWINGS

In referring to the drawings:

FIG. 5 is a side view of the lateral or side rod for the shoe rack applied for suspending it from a closet rail, or the like;

FIG. 6 is a bottom view thereof;

FIG. 7 is a side view of a lateral rod used to stabilize the interconnection of the shoe rack when assembled;

FIG. 8 is an end view thereof;

FIG. 9 is a plan view of a shoe support of this invention; and

FIG. 10 is a side view thereof.

DESCRIPTION OF THE PREFERRED EMBODIMENT

Figure 1:
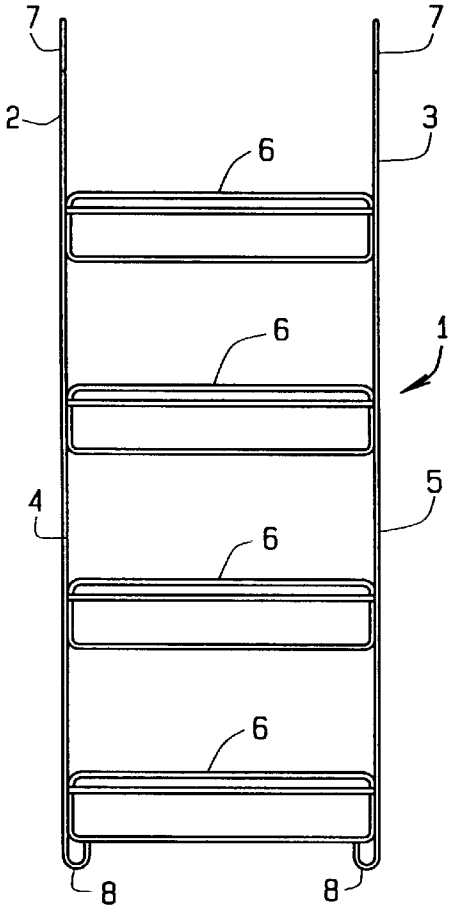
FIG. 1 is a front view of the suspension shoe rack of this invention.
Figure 2:
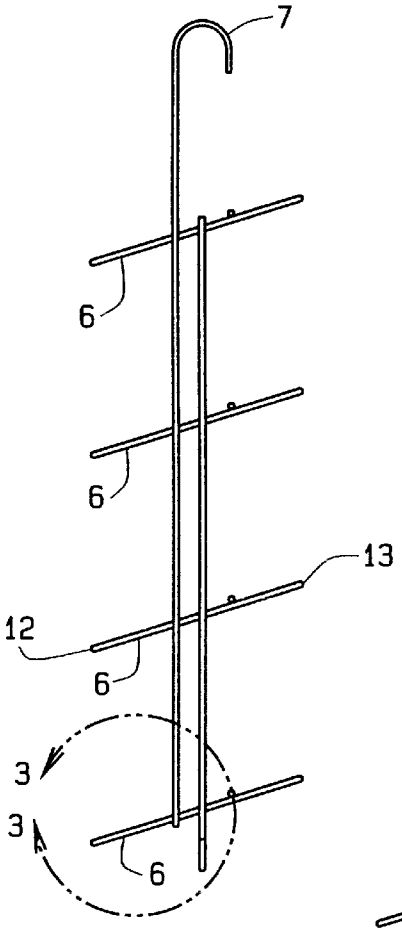
FIG. 2 is a side view thereof.

In referring to the drawings, and in particular FIGS. 1 and 2, the suspension shoe rack of this invention, is displayed at 1. The shoe rack, as can be seen, includes a pair of side supporting rods 2 and 3 which in combination with the lateral stabilizing rods 4 and 5, hold a plurality of incline arranged shoe supports 6, when assembled. The upper ends of the supporting rods 2 and 3 are turned, as at 7, and provide a means for rapidly suspending the shoe rack from a closet rod, close line, or other means of support, so that a plurality of shoes may be suspended upon their support 6, when the structure has been assembled, and readied for usage. The bottom of each of the stabilizing rods 4 and 5 are likewise turned, as at 8, and directed inwardly, as noted, in order to prevent the disposition of any sharpened lower edges, to the stabilizing rods, when the shoe rack assembly is installed for usage.

Figure 3:
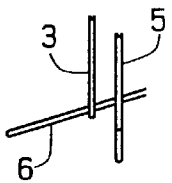
FIG. 3 is a partial view of interconnection between the lower portions of the side suspension rods and the lowest shoe support.

The relative length of the various lateral and stabilizing rods 4 and 5, relative to the lower shoe support 6, and which discloses the arrangement of these components when assembled, can be seen in FIG. 3.

Figure 4:
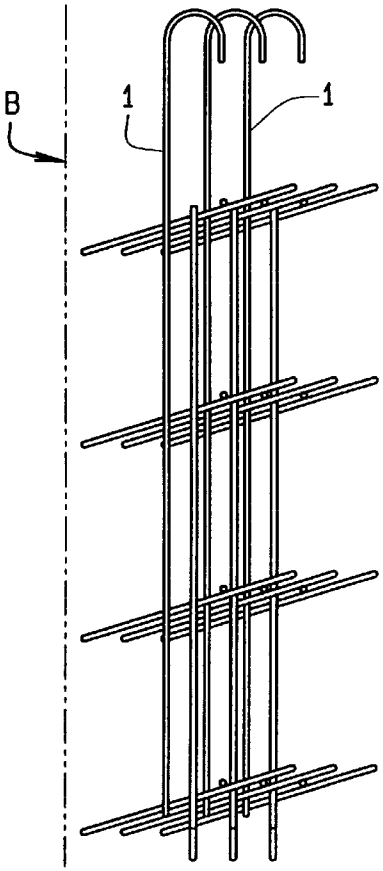
FIG. 4 is a side view of the nestability of a plurality of the suspension shoe racks of the this invention when packed for shipment, display, or storage.

FIG. 4 discloses how a plurality of the suspension shoe racks 1 can be nested together, due to the inclined configuration and structural location of the shoe supports 6, can be seen. In fact, there are twelve such shoe racks nested together, into a packing assembly, and which conveniently allows them to be either strapped together, located within a box, as noted at B, for ready shipment, storage, or even for display in that manner, within the retail outlet.

The various components that make up the assembly of this suspension shoe rack can be seen in FIGS. 5 through 10. As shown, the side suspension rod, as at 2 and 3, can be seen in FIG. 5. Its upper end 7 is turned, and as can be noted, and has sufficient radius so as to allow the shoe rack to be suspended, from any convenient support, such as a closet rod, or other line, or other means of support and providing suspension to the shoe rack, when used. The side stabilizing rods 4 and 5 likewise are shown, as is the lower end of each of such rods, being turned, as disclosed at 8, for the purposes as previously described.

The shoe supports 6 are also disclosed, and includes a perimeter frame, as shown at 9, which includes integrally, and formed in a bent configuration, the side rails 10 and 11, in addition to the front and back rails 12 and 13, respectively, as noted. In addition, a cross rail 14 is provided at approximately the third point, of the assembled perimeter frame, and this rail 14 is designed to allow for the insertion of the heels of any footwear stored thereon intermediate the location of the cross rail 14, and the upper or back rail 13, while the front of any shoe rests upon the front rail 12, which is arranged at an angle downwardly, and at a lower position than the back rail 13, as can be so clearly seen in FIG. 2. Thus, as previously explained, when the shoe supports are arranged, in this condition, during assembly of the shoe rack, the supports clearly display the plurality of footwear in their assembled condition, and which conveniently displays at least the vamp of the shoes, to the front, for ready observance by the user, to facilitate the selection of the footwear to be worn, that day, to the convenience of the user.

Thus, as can be readily understood from reviewing the structure, its assembly, and the method of its application, for the suspension shoe rack as disclosed herein, it becomes quite obvious that this device is designed for providing complete storage for the user, home owner, and the like, to assemble and temporarily store all of his/her shoes at one location, as when not in use, but at the same time, afford a means for providing a quick and ready inspection of any pair of shoes, for selection for use and application that day, as needed. And, such a suspension shoe rack can be readily employed within the closet, adjacent or in proximity with the clothing being selected for wearing that day, to the convenience of the user.

Variations or modifications to the structure and assembly of this invention may occur to those skilled in the art upon reviewing the invention as described herein. Such variations, if within the scope of this development, are intended to be encompassed within the spirit of this invention, as described herein. For example, only one side supporting rod 2 or 4, and 3 or 5, may be used at a time within the structure of this device, and have the various shoe supports welded directly thereto, without the need for usage of any of the stabilizing rod 4 and 5, and yet provide a convenient suspension rack for holding a plurality of shoes, in place, as required. In addition, the shoe supports 6 may also be arranged level, rather than on an incline, to provide better balance during usage. The description of the preferred embodiment as set forth herein, and the drawings which display that embodiment, is only provided for illustrative purposes only.

What is claimed is:

1. A suspended shoe rack comprising:

at least two side supporting rods, said side supporting rods being in vertical orientation, and having an upper part and a lower part, said supporting rods being parallel with respect to one another;

means towards the upper part of said side supporting rods for engaging a preexisting horizontally disposed support;

a plurality of integrally formed shoe supports, each said plurality of shoe supports having a front rail, a back rail, and two side rails, each of said side rails of said shoe supports affixed to said side supporting rods and spaced from the upper part of each of said side supporting rods respectively, said side rails of said plurality of shoe supports being disposed generally perpendicular to said vertical side supporting rods;

said plurality of shoe supports being disposed approximately horizontally;

at least one vertically disposed stabilizing rod is attached to each side rail of said shoe supports at a position other than the position to where the vertical side supporting rods are secured, and between the front rails and said back rails of said plurality of shoe supports; and wherein a plurality of said suspended shoe racks are capable of nesting together during shipment and storage.

* * * * *